US009750383B2

(12) United States Patent
Janzen et al.

(10) Patent No.: US 9,750,383 B2
(45) Date of Patent: Sep. 5, 2017

(54) CLEANING BRUSH FOR A FLOOR CLEANER AND FLOOR CLEANER WITH A CLEANING BRUSH

(71) Applicant: Alfred Karcher GmbH & Co. KG, Winnenden (DE)

(72) Inventors: Jacob Janzen, Backnang (DE); Annette Holzer, Stuttgart (DE); Martin Schmidgall, Aspach (DE); Guenther Erbel, Schwaebisch Hall-Hessental (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 83 days.

(21) Appl. No.: 14/740,624

(22) Filed: Jun. 16, 2015

(65) Prior Publication Data

US 2015/0272414 A1 Oct. 1, 2015

Related U.S. Application Data

(63) Continuation of application No. PCT/EP2012/076040, filed on Dec. 18, 2012.

(51) Int. Cl.
*A47L 11/40* (2006.01)
*A47L 9/04* (2006.01)

(52) U.S. Cl.
CPC ..... *A47L 11/4041* (2013.01); *A47L 9/0444* (2013.01); *A47L 9/0455* (2013.01); *A47L 9/0477* (2013.01); *A47L 11/4069* (2013.01); *A47L 2201/00* (2013.01)

(58) Field of Classification Search
CPC .... A47L 9/0477; A47L 9/0455; A47L 9/0444; A47L 11/4041; A47L 11/4069
See application file for complete search history.

(56) References Cited

U.S. PATENT DOCUMENTS 3,744,077 A 7/1973 Smyth
4,222,146 A 9/1980 Hertzberg
5,213,421 A * 5/1993 Ide ..... A47L 5/30 384/192

(Continued)

FOREIGN PATENT DOCUMENTS

DE 10 2007 006 654 8/2008
DE 10 2007 060 750 6/2009

(Continued)

*Primary Examiner* — Shay Karls
(74) *Attorney, Agent, or Firm* — Womble Carlyle Sandridge & Rice LLP

(57) ABSTRACT

The invention relates to a cleaning brush for a floor cleaner, in particular, a self-propelled and self-steering floor cleaner, including at least one brush unit having a brush body defining a brush axis and being provided with cleaning bristles and having a first end and a second end, the at least one brush unit including at the first end or in the region of the first end a torque receiver device for coupling with a drive device of the floor cleaner. To provide such a cleaning brush which can be reliably mounted on a floor cleaner in a constructionally simple way, the at least one brush unit includes a bearing device for mounting on the floor cleaner, which is arranged between the first end and the second end. The invention also relates to a floor cleaner with a cleaning brush, in particular, a self-propelled and self-steering floor cleaner.

33 Claims, 6 Drawing Sheets

(56) References Cited

U.S. PATENT DOCUMENTS 7,774,158 B2 * 8/2010 Domingues Goncalves .....
G01C 21/12
701/26

FOREIGN PATENT DOCUMENTS

| | | | | |
|---|---|---|---|---|
| DE | 10 2010 060 373 | | 5/2012 | |
| EP | 0042370 | A1 * | 12/1981 | ..... A47L 9/0411 |
| EP | 0 072 360 | | 2/1983 | |
| EP | 1 043 947 | | 3/2003 | |
| EP | 2 443 978 | | 4/2012 | |

* cited by examiner

FIG.6
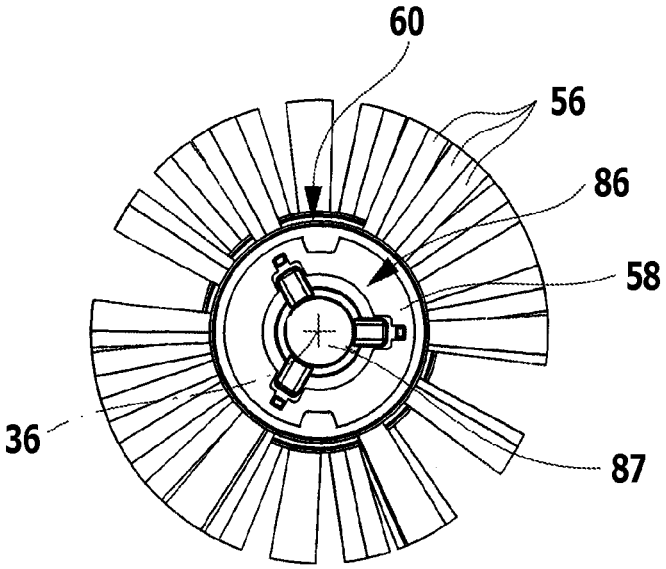
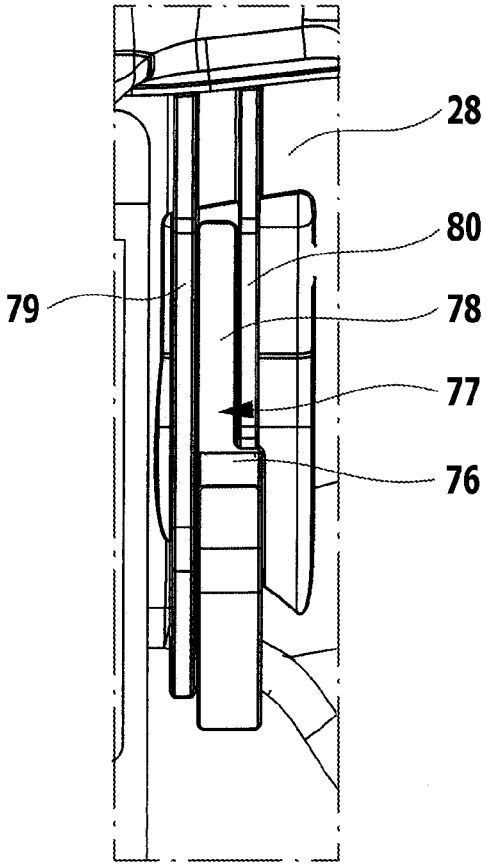
FIG.7

CLEANING BRUSH FOR A FLOOR CLEANER AND FLOOR CLEANER WITH A CLEANING BRUSH

CROSS-REFERENCE TO RELATED APPLICATIONS

This application is a continuation patent application of international application number PCT/EP2012/076040, filed on Dec. 18, 2012, which is incorporated herein by reference in its entirety and for all purposes.

FIELD OF THE INVENTION

The present invention relates to a cleaning brush for a floor cleaner, in particular, a self-propelled and self-steering floor cleaner, comprising at least one brush unit having a brush body defining a brush axis and being provided with cleaning bristles and having a first end and a second end, the at least one brush unit comprising at the first end or in the region of the first end a torque receiver device for coupling with a drive device of the floor cleaner.

The invention also relates to a floor cleaner with a cleaning brush, in particular, a self-propelled and self-steering floor cleaner.

BACKGROUND OF THE INVENTION

DE 10 2007 006 654 A1 describes a cleaning head for a floor cleaner and a cleaning brush included therein. Arranged on the cleaning head is a drive device for driving two brush units of the cleaning brush, which comprises an elongated, axial and rotatable shaft. The brush units are mounted on the drive shaft, and this engages the brush bodies over almost the entire length. A torque receiver device arranged at the first end of the respective brush unit couples with a catch of the shaft as component of the drive device. The required length of the shaft for the brush body to be reliably supported proves disadvantageous in practice. This means that, in order to avoid damage, the shaft must be relatively large, solid and made of a robust material, for example, metal, particularly since it is subjected to high leverage owing to the forces acting radially on the brush body, in particular, at the first end. The manufacturing costs of a drive device with such a shaft are relatively high. Furthermore, during operation of the drive device, a relatively large mass has to be moved. This proves disadvantageous, in particular, when a cleaning brush and the drive device are used in a self-propelled and self-steering floor cleaner which is battery-operated. Owing to the large masses moved, disproportionately high demands are made on the battery of the floor cleaner solely for driving the brush.

In the present case, "axial" and "radial" are to be understood in relation to the brush axis, unless a different explanation is given. Furthermore, the following statements relate to a specified use of the cleaning brush on a floor cleaner, the cleaning brush being seen as being aligned with a horizontal axis of rotation and contacting a floor surface to be cleaned.

An object underlying the present invention is, therefore, to provide a cleaning brush which can be reliably mounted on a floor cleaner in a constructionally simple way.

Another object underlying the present invention is to provide a floor cleaner having a cleaning brush which can be reliably mounted on the floor cleaner in a constructionally simple way.

SUMMARY OF THE INVENTION

In a first aspect of the invention, a cleaning brush for a floor cleaner is provided, in particular, for a self-propelled and self-steering floor cleaner. The cleaning brush comprises at least one brush unit having a brush body defining a brush axis and is provided with cleaning bristles and has a first end and a second end, the at least one brush unit comprising at the first end or in the region of the first end a torque receiver device for coupling with a drive device of the floor cleaner. The at least one brush unit comprises a bearing device for mounting on the floor cleaner, which is arranged between the first end and the second end.

In a second aspect of the invention, a floor cleaner is provided, in particular, a self-propelled and self-steering floor cleaner. The floor cleaner comprises a housing forming a brush accommodating compartment, a cleaning brush of the kind described hereinabove arranged in the brush accommodating compartment with at least one brush unit, and a drive device for the cleaning brush, which is coupled at the first end of the brush body of the at least one brush unit to its torque receiver device and which rotationally drives the at least one brush unit.

BRIEF DESCRIPTION OF THE DRAWINGS

The foregoing summary and the following description may be better understood in conjunction with the drawing figures, of which:

FIG. 6 shows an end-face view of a first end of a brush unit of the cleaning brush from FIG. 4; and FIG. 7 shows a detailed representation of a wall of a brush accommodating compartment of the floor cleaner from FIG. 1.

DETAILED DESCRIPTION OF PREFERRED EMBODIMENTS OF THE INVENTION

Figure 1:
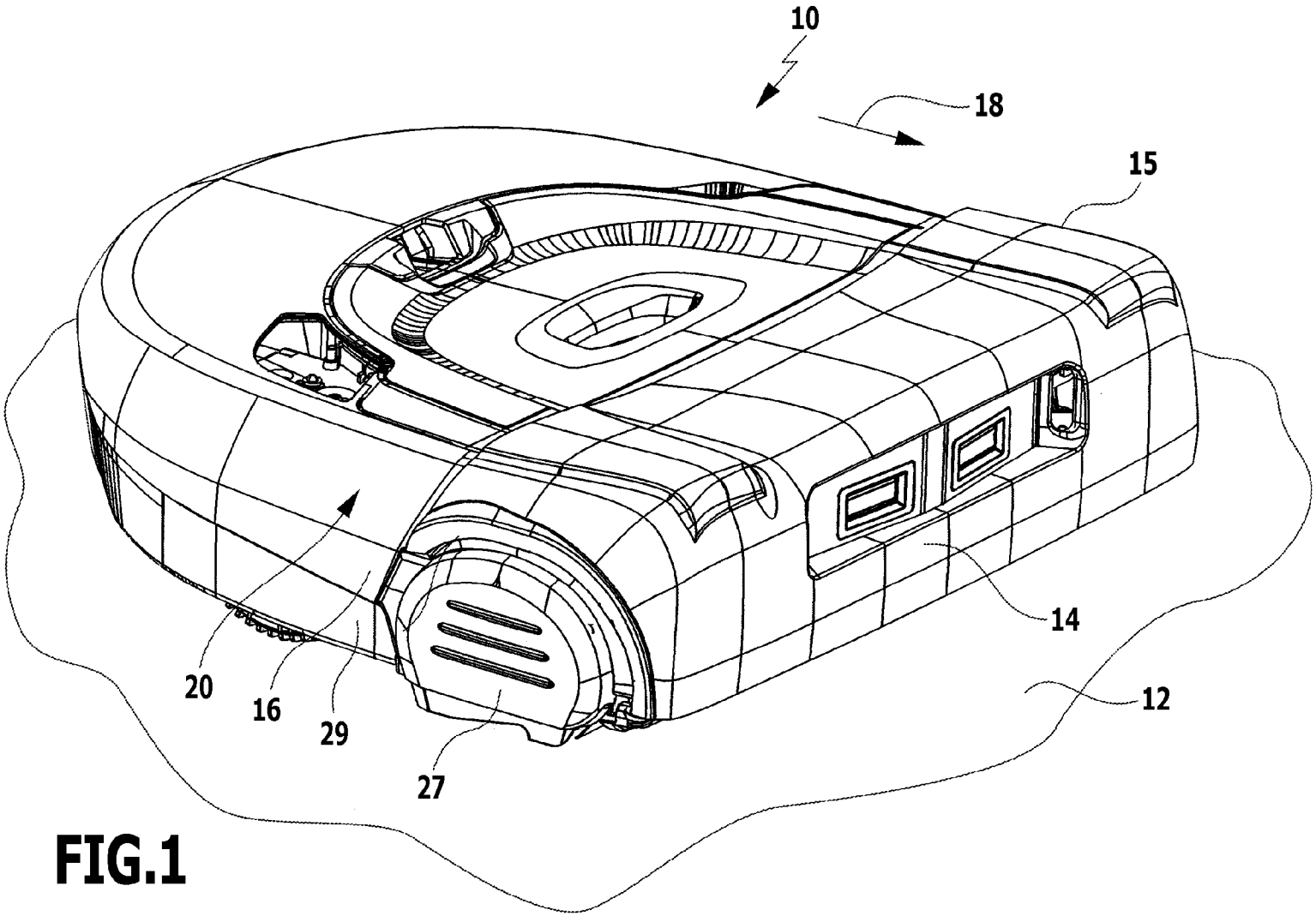
FIG. 1 shows a perspective representation of a floor cleaner in accordance with invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a cleaning brush for a floor cleaner, in particular, a self-propelled and self-steering floor cleaner, comprising at least one brush unit having a brush body defining a brush axis and being provided with cleaning bristles and having a first end and a second end, the at least one brush unit comprising at the first end or in the region of the first end a torque receiver device for coupling with a drive device of the floor cleaner. The at least one brush unit comprises a bearing device for mounting on the floor cleaner, which is arranged between the first end and the second end.

With the cleaning brush in accordance with the invention, a bearing device is used, which, in relation to the brush axis, is arranged axially between the first end and the second end and, therefore, at a distance from the second end on the brush body. The bearing device allows the at least one brush unit to be rotatably mounted and to be supported on the floor cleaner by way of a section arranged radially outside of the brush body. A torque exerted by the drive device is transmitted by way of the torque receiver device at the first end to the brush body. Differently than with the cleaning head described in DE 10 2007 006 654 A1, the provision of the bearing device on the cleaning brush allows a drive device and torque transmitter device of relatively small configuration to be used. Unlike in the cited publication, it is, in particular, not necessary to provide a shaft of the drive device extending close to the second end of the brush body. Instead, the at least one brush unit can be supported on the floor cleaner in a spatially limited manner, namely, on the one hand, at or in the region of the first end on the drive device and, on the other hand, by way of the bearing device at a distance from the second end. Owing to the arrangement of the bearing device at a distance from the second end, radial forces acting on the brush body can be conducted away better to the floor cleaner. In particular, the risk of the brush body bending between the torque receiver device and the bearing device is reduced.

The at least one brush unit is preferably free of a bearing device for mounting on the floor cleaner at the second end, which is enabled, for example, by the arrangement of the bearing device at a distance from the second end. This allows, for example, an improved cleaning result to be achieved by cleaning bristles projecting beyond the second end, as will be explained in more detail hereinbelow.

It is advantageous for the bearing device to be at a distance from the first end, which corresponds to approximately 50% to approximately 70% of the length of the brush body, preferably approximately 60%.

It is expedient for the brush body to be provided with cleaning bristles on both sides of the bearing device, and for cleaning bristles arranged on opposite sides of the bearing device and adjacent thereto to be positioned at an axial inclination in relation to the brush axis in the direction of the respective other side of the bearing device. Cleaning bristles arranged on opposite sides of the bearing device are inclined, and they are aligned in the direction of the respective other side of the bearing device. This allows dirt to be removed from the floor surface to be cleaned also in the region of the bearing device by means of the inclined cleaning bristles.

It is particularly expedient if on a floor surface to be cleaned, sweeping patterns of the cleaning bristles positioned at an inclination on opposite sides of the bearing device border on one another or overlap one another. In particular, this can be understood as meaning that the inclined cleaning bristles on opposite sides of the bearing device intersect or cross one another assuming that they adopt the same angular position in the circumferential direction of the brush axis. "Sweeping pattern" is regarded as the area of contact of the cleaning bristles with a floor surface to be cleaned during specified use of the cleaning brush. The sweeping pattern defines the area covered and, consequently, cleaned by the cleaning brush. The sweeping patterns of the inclined cleaning bristles on opposite sides of the bearing device border on one another or overlap one another and so streak-free cleaning of the floor surface in the region of the bearing device is also possible using the cleaning brush.

It is advantageous for the sweeping patterns, in an unstressed state of the brush, to border on one another or overlap one another in the direction of the floor surface to be cleaned.

Furthermore, it is expedient for the cleaning bristles at or near the first end and/or the second end to be positioned at an axial inclination in relation to the brush axis and to project beyond the first end and beyond the second end, respectively, of the brush body. This allows sections of the floor surface arranged laterally next to the first end and/or the second end to also be cleaned with the cleaning brush. Owing to the cleaning bristles positioned at an inclination, the sweeping pattern of the cleaning brush extends beyond the first end and beyond the second end, respectively. At the second end, this proves advantageous, in particular, when the at least one brush unit, as mentioned hereinabove, is free of a bearing device at the second end. At the first end, the floor surface underneath the drive device arranged laterally next to the first end can also be cleaned when the inclined cleaning bristles project as far as below the drive device.

In a constructionally simple configuration, the torque receiver device has a recess arranged at the first end in the brush body for a corresponding drive element of the drive device. The drive element can engage the recess, in particular, with positive locking in order to transmit a torque to the brush body.

In an advantageous embodiment of the cleaning brush in accordance with the invention, it is expedient for the brush body to be axially divided into a first brush body segment forming the first end and a second brush body segment forming the second end, the second brush body segment being connected to the first brush body segment. They are preferably connected to each other in a rotationally fixed manner in order to transmit a torque from the first brush body segment to the second brush body segment.

It is advantageous for the brush body segments to be connected to each other at the bearing device, and for the bearing device to be arranged axially between the brush body segments. It is found in practice that a compact construction of the at least one brush unit can thereby be achieved.

For connecting the brush body segments, the brush body preferably comprises a torque transmitter member engaging these, in each case, in a rotationally fixed manner, and extending through the bearing device. A torque can be transmitted from the first to the second brush body segment by the torque transmitter member. The brush body can be supported on the bearing device through which the torque transmitter member extends. The torque transmitter member is configured, for example, as shaft engaging the brush body segments.

In an advantageous implementation of the cleaning brush in accordance with the invention in practice, it is expedient for the bearing device to comprise a bearing body and, in relation to the brush axis, to comprise or form a radial bearing, and for the bearing body to have a bearing section which is mounted by way of the radial bearing on the brush body, and a fixing section which is connected to the bearing section and on which at least one fixing member is arranged for fixing to the floor cleaner. The brush body, for example, the torque transmitter member—preferably the aforementioned shaft—can be radially mounted on the bearing section of the bearing body by way of the radial bearing. The bearing body and, therefore, the at least one brush unit can be fixed to the floor cleaner by way of the fixing section. The at least one fixing member is arranged radially outside of the brush body, it being, for example, possible for it to be connected to a wall of a brush accommodating compartment of the floor cleaner, in which the cleaning brush is arranged.

For reliable mounting of the cleaning brush, it proves advantageous for the radial bearing to be configured as ball bearing.

The ball bearing is, for example, arranged radially between the bearing section and the brush body or its torque transmitter member.

In a different advantageous embodiment, it is expedient for the radial bearing to be configured as slide bearing. Here it is conceivable for the bearing section to be mounted slidingly on the brush body or its torque transmitter member.

The bearing body preferably comprises at least one spring member by way of which the bearing section is supported in an axially and/or radially sprung manner on the fixing section. For example, the at least one spring member allows axial resilience. This makes it possible to act upon the brush body in the direction of the drive device. Reliable rotationally fixed connection thereof to the torque receiver device can thereby be ensured, with axial play and tolerances being compensated. A radial resilience of the at least one brush unit allows, for example, unevenesses of the floor to be compensated. Conversely, radial movements of the at least one brush unit are not transmitted or only to a muted extent to the fixing section. The mounting of the at least one brush unit on the floor cleaner is thereby subjected to lower forces.

In an effective and constructionally simple implementation in practice, it is expedient for spring webs connecting the bearing section and the fixing section to each other to be provided as spring members. For example, the spring webs connect a fixing section surrounding the bearing section in the shape of a ring.

For simple handling and constructionally simple configuration of the cleaning brush, it is advantageous for the at least one fixing member to comprise or form a locking element for locking to a corresponding locking element of the floor cleaner. The fixing member is, for example, a locking projection which interacts with a corresponding locking receptacle on the floor cleaner. The locking projection is, for example, of hook-shaped configuration in order to fix the bearing body suspended on a wall of the brush accommodating compartment of the floor cleaner.

The at least one fixing member is preferably configured to form a rotational lock with the floor cleaner, for example, in the manner of a bayonet connection, it being possible for the fixing member to be inserted into a receptacle on the floor cleaner and fixed on the receptacle by rotation.

The bearing body is preferably in one piece so as to enable a constructionally simple configuration of the cleaning brush.

Furthermore, it is conceivable for at least a section of the bearing body to be of plate-shaped configuration. For example, the fixing section of the bearing body is of plate-shaped configuration.

It is particularly expedient for the cleaning brush to comprise two brush units. In particular, the brush units are configured as described hereinabove in the example of the at least one brush unit of the cleaning brush in accordance with the invention and advantageous embodiments thereof.

Both brush units can preferably be separately connected to the drive device and fixed to and mounted on the floor cleaner by way of the respective bearing device.

It is particularly preferable for the brush units, in relation to coinciding brush axes thereof, to be configured symmetrically or substantially symmetrically relative to each other with respect to a plane of symmetry which is aligned perpendicularly to the brush axes of the brush units. The plane of symmetry is arranged between the respective first ends of the brush units at which the drive device can be arranged when the cleaning brush is used on the floor cleaner. The brush units can deviate from a symmetry, for example, with respect to their cleaning bristles.

The present invention further relates to a floor cleaner. A floor cleaner in accordance with the invention is, in particular, a self-propelled and self-steering floor cleaner. It comprises a housing forming a brush accommodating compartment, a cleaning brush of the kind described hereinabove arranged in the brush accommodating compartment with at least one brush unit, and a drive device for the cleaning brush, which is coupled at the first end of the brush body of the at least one brush unit to its torque receiver device and which rotationally drives the at least one brush unit.

As mentioned above in conjunction with the explanation of the cleaning brush in accordance with the invention, its use allows mounting, on the one hand, at the first end and, on the other hand, by way of the bearing device at a distance from the first and from the second end on the floor cleaner. Reference is made at this juncture to the advantages mentioned above in conjunction with the explanation of the cleaning brush.

The brush axis is, for example, a transverse axis aligned transversely to the main direction of movement of the floor cleaner.

It is expedient for the drive device to comprise a drive element which is rotationally drivable about the brush axis and engages a corresponding recess of the brush body. A torque can be transmitted to the brush body from the drive device by the preferably positively locking engagement.

The drive device advantageously comprises a drive motor outside of the brush accommodating compartment and a torque transmitter device interacting with the drive motor, the torque transmitter device being arranged in the brush accommodating compartment and being coupled to the torque receiver device of the at least one brush unit. The drive device, which is preferably fixed to the cleaner, comprises the drive motor, in particular, an electric motor. It is arranged outside of the brush accommodating compartment to protect it against dirt. The drive device can comprise a gear mechanism for driving the torque transmitter device, which is coupled in the brush accommodating compartment to the torque receiver device.

It is expedient for the floor cleaner to comprise or form at or in the brush accommodating compartment at least one fixing member which interacts with a fixing member of the bearing device of the at least one brush unit to fix the cleaning brush on the floor cleaner. The interacting fixing members allow the at least one brush unit to be fixed by way of the bearing device to the floor cleaner.

In a constructionally simple configuration, the at least one fixing member of the floor cleaner is preferably included in or formed by a wall of the brush accommodating compartment.

It is advantageous for the at least one fixing member of the floor cleaner to comprise or form locking element for locking to a corresponding locking element of the cleaning brush. For example, the fixing member is a locking receptacle on which a locking projection of the bearing device locks. The locking receptacle is, for example, of slit-shaped configuration and so the bearing device and, therefore, the at least one brush unit can be fixed in a suspended position by way of a hook-shaped locking projection on a wall of the brush accommodating compartment.

The at least one fixing member of the floor cleaner is preferably configured to form a rotational lock with the fixing member of the cleaning brush, for example, in the manner of a bayonet connection.

All in all, it is advantageous for the cleaning brush to be releasably connectable to the remaining floor cleaner. For example, the first end of the at least one brush unit can be fitted on the drive device, for example, in the axial or substantially axial direction. A drive element of the drive device can engage a corresponding recess at the first end. The bearing device can then be locked to a wall of the brush accommodating compartment. The at least one brush unit is then held by way of the bearing device and the coupling with the drive device on the floor cleaner. Conversely, the locking of the bearing device to the wall of the brush accommodating compartment can be released, and the at least one brush unit can then be removed in the direction facing away from the drive device.

In particular, it proves advantageous for the cleaning brush to be fixable to and releasable from the floor cleaner manually and/or without any tools.

It is expedient for the cleaning brush to comprise two brush units, the brush axes of which coincide, and for at least a section of the drive device to be axially arranged between the brush units. The two brush units can be coupled to the drive device from sides facing away from each other, and their torque receiver devices can interact with a torque transmitter device of the drive device. The two brush units are preferably, as explained hereinabove, symmetrically configured in relation to a plane of symmetry aligned perpendicularly to the brush axes.

It is advantageous for the cleaning bristles of the brush units arranged at or near the respective first ends to be positioned at an axial inclination and to project beyond the respective first ends in the direction of the respective other brush unit, and on a floor surface to be cleaned, for sweeping patterns of the cleaning bristles of both brush units to border on one another or overlap one another. Cleaning bristles of the brush units project from their respective first end in the direction of the other brush unit. This allows a floor surface in the region of the drive device to also be cleaned with the cleaning bristles. In particular, the sweeping patterns of the respectively inclined cleaning bristles border on one another or preferably overlap. This enables streak-free cleaning of the floor surface in the region of the drive device to also be achieved with the cleaning brush.

The sweeping patterns, in an unstressed state of the cleaning brush, advantageously border on one another or overlap in the direction of the floor surface to be cleaned.

It is advantageous for the housing to comprise or form brush covers which cover at least sections of the respective second ends of the brush bodies at the end face, the brush covers covering the cleaning bristles at the end face preferably completely or substantially completely. This allows the brush accommodating compartment to be delimited at the sides, which proves advantageous, for example, when the floor cleaner comprises a suction unit for sucking off swept-off dirt particles. Admission of air at the sides into the brush accommodating compartment can thereby be substantially avoided and the cleaning result improved. Moreover, the brush covers serve to protect obstacles present in the area to be cleaned against contact with the rotating cleaning brush, for example, curtains or drapes which could be caught, wound up and damaged by the cleaning brush.

It is particularly advantageous for at least one brush cover to be constructed so as to be movable relative to the remaining housing and to be transferable from a bristle covering position in which the brush cover projects laterally along the brush axis over cleaning bristles arranged at or near the second end of the brush unit facing it, to a bristle releasing position in which the cleaning bristles project along the brush axis laterally over the brush cover, and vice versa. This enables, in particular, improved cleaning of edge regions of an area to be cleaned, as described in detail in the patent application DE 10 2012 104 326.4 of the same applicant. Reference is made herein to this patent application, and its contents are incorporated in full in the present application. By transferring the at least one brush cover from the bristle covering position to the bristle releasing position, the cleaning bristles can project at the second end laterally over the brush cover. In this way, some of the cleaning bristles can project with the free bristle ends on the outside from the floor cleaner, in particular, over its base area. Edges and corners which are difficult to clean can thereby also be effectively cleaned. In the bristle covering position, the brush cover projects over the cleaning bristles in order to, as explained hereinabove, prevent obstacles from contacting the cleaning brush. The brush cover is transferred, for example, by the application of force in the direction towards the second end of the adjacent brush unit from the bristle covering position to the bristle releasing position. In the present advantageous embodiment of the floor cleaner, it is expedient for the cleaning brush to be free of a bearing device at the second end so that the brush cover can be moved up as close as possible to the second end.

Both brush covers are preferably movable from a bristle covering position to a bristle releasing position, in each case, and vice versa.

In a constructionally simple configuration, the at least one movable brush cover is displaceable on the housing relative to the cleaning brush in order to transfer it from the bristle covering position to the bristle releasing position and vice versa.

It is advantageous for the at least one movable brush cover to be arranged on the outside of the housing and, in the bristle covering position, preferably also in the bristle releasing position, to form a section of the outer contour of the housing. This makes it possible for the brush cover to contact an obstacle such as, in particular, an edge or wall, and as a result of the contact to be transferred from the bristle covering position in the direction of its bristle releasing position. The brush cover preferably also forms a section of the outer contour in the bristle releasing position, so that permanent contact with an obstacle can be maintained while cleaning bristles project over the brush cover to enable cleaning along the edge or wall.

The floor cleaner can be of self-propelled and self-steering configuration so as to enable autonomous cleaning of a floor surface.

It is advantageous for the floor cleaner to comprise no abrasive cleaning tools other than the at least one cleaning brush, in particular, no additional sweeping units with cleaning bristles projecting over a base area of the floor cleaner.

FIG. 1 shows in a perspective view an advantageous embodiment, designated in its entirety by reference numeral 10, of a floor cleaner in accordance with the invention. The floor cleaner 10 is a self-propelled and self-steering cleaner and is constructed as a so-called "cleaning robot", with which a floor surface 12 can be cleaned autonomously. The floor cleaner 10 has a front side 14, a left side 15 and a right side 16.

In the present case, indications of position and orientation such as, for example, "at the front", "at the top", "at the bottom", "horizontal" and "vertical" are to be understood in relation to specified use of the floor cleaner 10 during which it is positioned on the floor surface 12 assumed to be horizontal, and in relation to a longitudinal or main direction of movement 18 of the floor cleaner 10.

A housing 20 forms near the front side 14 a brush accommodating compartment 22 for a cleaning brush 24 which, in the present case, is a preferred embodiment of a cleaning brush in accordance with the invention. The brush accommodating compartment 22 extends in the transverse direction over the entire width of the floor cleaner 10. Brush covers 26 and 27 at the left side 15 and the right side 16, respectively, delimit the brush accommodating compartment 22 at the sides and cover end sides of the cleaning brush 24, as will be explained hereinbelow. The brush covers 26 and 27 are arranged at the outer contour of the floor cleaner 10 and form an outer lateral delimitation thereof.

The brush accommodating compartment 22 is delimited in the direction of the front side 14, at the top side and in sections thereof towards the rear by a wall 28. The wall 28 is formed by a supporting chassis 29 of the housing 20. In the longitudinal direction behind the cleaning brush 24, an opening 30 is formed in the wall 28. Through the opening 30, dirt swept off the floor surface 12 with the cleaning brush 24 can be swept into a dirt collection container 32 of the floor cleaner 10 and separated therein. This is done under the supplementary action of a suction unit, not shown in the drawings, of the floor cleaner 10.

Somewhat upstream of the opening 30 in the longitudinal direction 18, the floor cleaner 10 has a guide element 34 rising at an incline from the front to the rear for dirt swept off the floor surface 12. The dirt can be transported by way of the guide element 34 in the direction of the opening 30 and so the guide element 34 forms a sweeping edge for sweeping up dirt. It extends over almost the entire width of the floor cleaner 10 in the brush accommodating compartment 22.

The cleaning brush 24 extends substantially over the entire width of the floor cleaner 10 between the brush covers 26 and 27 and is aligned transversely to the longitudinal direction 18, thereby defining a brush axis 36. The brush axis 36 extends parallel to the floor surface 12 and horizontally.

The cleaning brush 24 is rotationally drivable about the brush axis 36, as will be explained herein below, with the cleaning brush 24 sweeping dirt in accordance with the "dustpan" principle rearwards over the guide element 34. The floor cleaner 10 comprises a drive device 38, shown in FIGS. 3 and 4, for driving the cleaning brush 24.

The drive device 38 has a drive motor 41 arranged in a motor housing 40, which, in the present case, is configured as an electric motor. The drive motor 41 is supplied with electrical energy by batteries, not shown in the drawings, of the floor cleaner 10.

Figure 3:
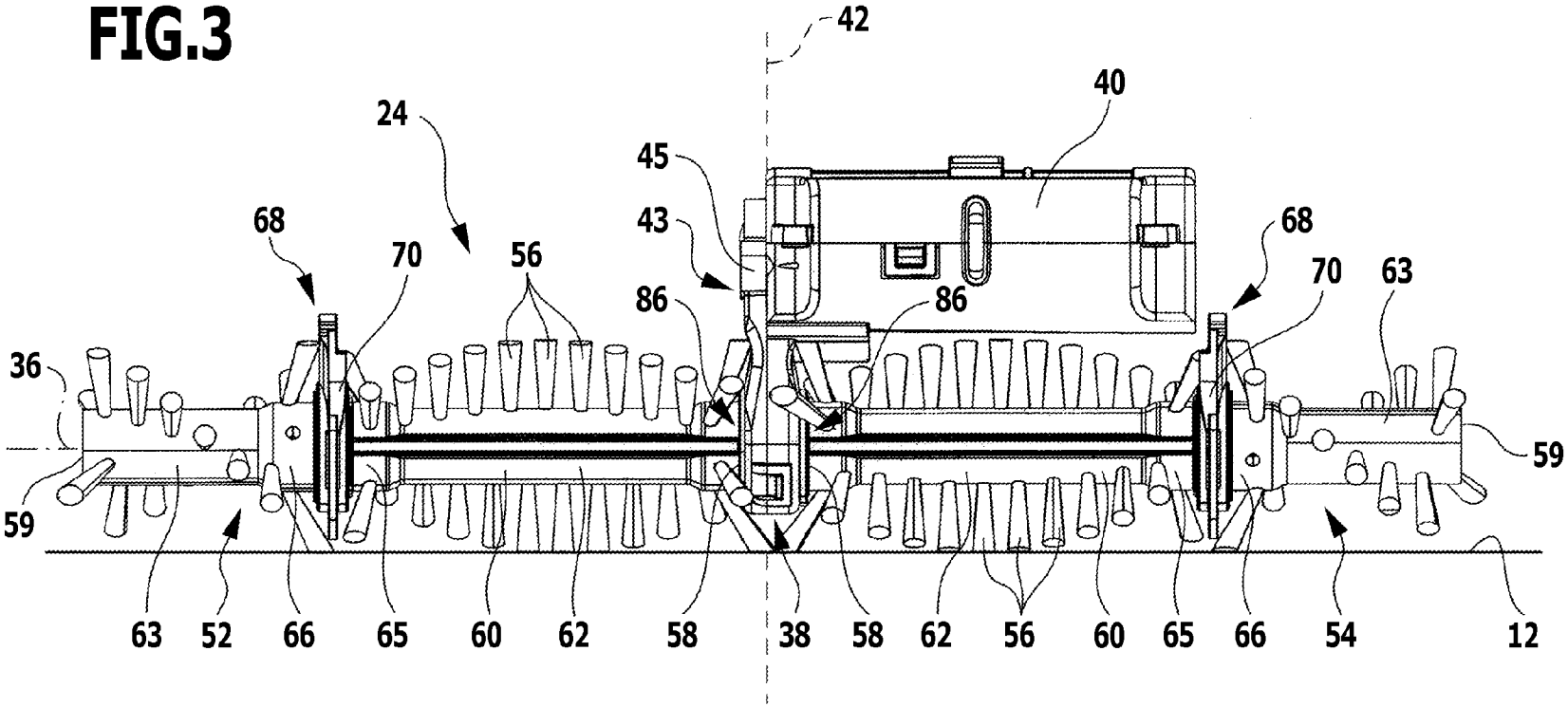
FIG. 3 shows a longitudinal side view of a cleaning brush in accordance with the invention of the floor cleaner from FIG. 1 and a drive device for the cleaning brush.
Figure 4:
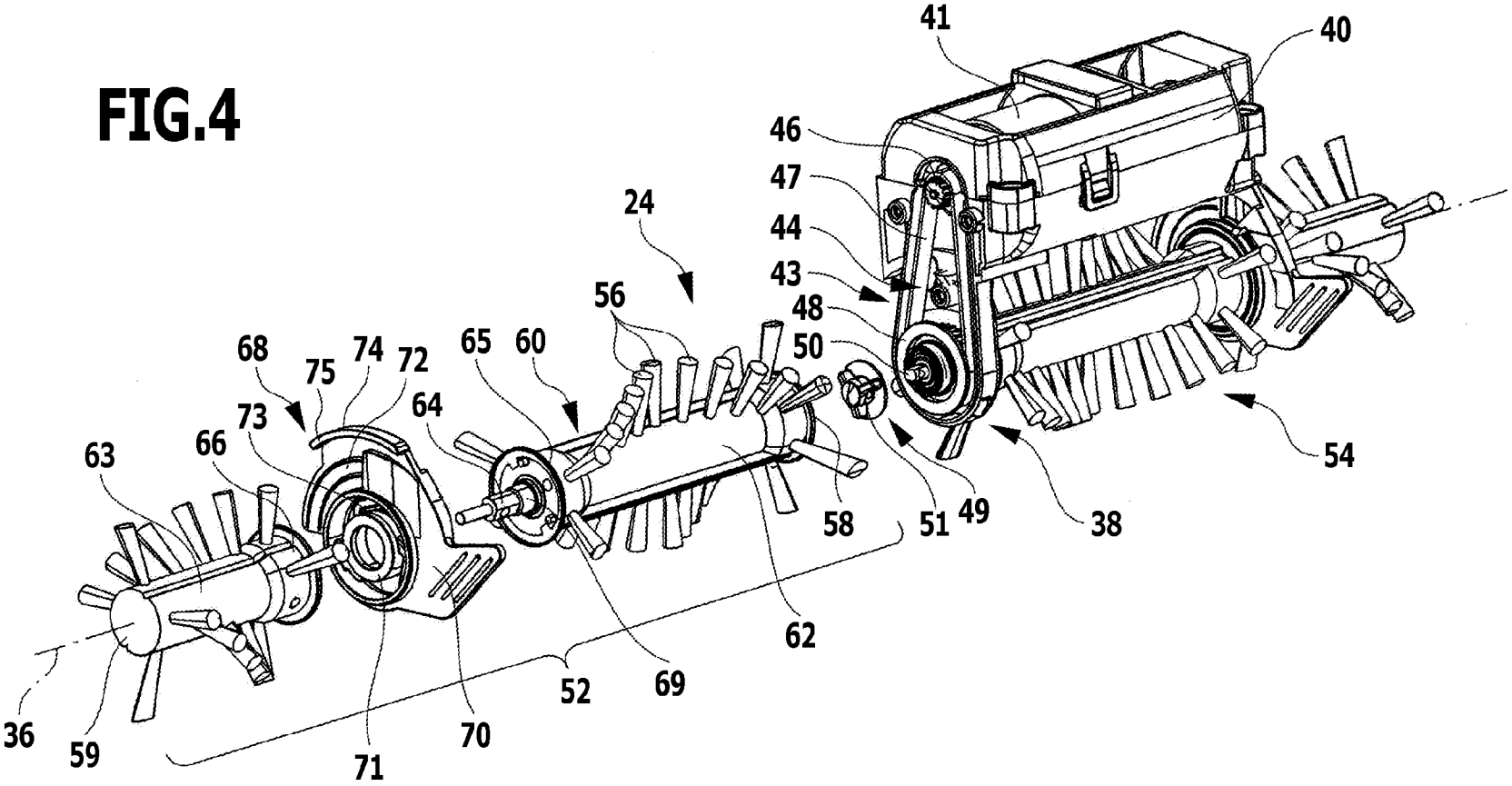
FIG. 4 shows a perspective view, partly in exploded representation, of the cleaning brush and the drive device from FIG. 3.

The motor housing 40 is connected at a median longitudinal plane 42 of the floor cleaner 10 to a gear housing 43 of the drive device 38, in which a gear mechanism 44 is arranged. A view of the gear mechanism 44 is given in FIG. 4, in which a half-shell-shaped cover 45 of the gear housing 43 (FIG. 3) is not shown. The gear mechanism 44 comprises, in the present case, a gear wheel 46 which is rotationally fixedly connected to a shaft of the drive motor 41 and drives a gear belt 47 which rotationally drives a further gear wheel 48 in the brush accommodating compartment 22. Coupled to the gear wheel 48 is a torque transmitter device 49, comprising a drive shaft 50, rotationally fixedly connected to the gear wheel 48 and extending through the gear housing 43, and two drive elements 51 rotationally fixedly connected to the drive shaft 50. The drive elements 51 are arranged on sides outside of the gear housing 43 that face away from each other (only one is shown in FIG. 4). An axis of the drive shaft 50 is in alignment with the brush axis 36.

The drive device 38 is fixed to the cleaner. It is fixed on the chassis 29, more specifically, by way of the motor housing 40 which, as well as an upper section of the gear housing 43, is arranged outside of the brush accommodating compartment 22. The motor housing 40 is positioned on the right side of the median longitudinal plane 42. A lower section of the gear housing 43 and the torque transmitter device 49 are arranged in the brush accommodating compartment 22.

The cleaning brush 24 comprises two brush units 52 and 54, the brush unit 52 being arranged on the left and the brush unit 54 on the right side of the median longitudinal plane 42. Both brush units 52, 54 define the common brush axis 36. The brush units 52 and 54 are formed substantially symmetrically to each other in relation to a plane of symmetry which coincides with the median longitudinal plane 42 and, accordingly, is aligned perpendicularly to the brush axis 36. The bristles of the brush units 52, 54 are excluded from the symmetry. Their cleaning bristles 56 need not necessarily be arranged symmetrically to one another, although this is, of course, also possible.

Owing to the extensive symmetry of the brush units 52, 54, only brush unit 52 will be discussed hereinbelow. The explanations referring to this also apply to the brush unit 54, for the features and components of which the same reference numerals are used as for those of the brush unit 52.

The brush unit 52 comprises a first end 58 which faces the gear housing 43, and a second end 59 which faces the brush cover 26. The brush unit 52 further comprises a brush body 60 defining the brush axis 36 and having two substantially cylindrical brush body segments 62 and 63. The brush body segment 62 thereof forms the first end 58, and the brush body segment 63 thereof forms the second end 59. Both brush body segments 62 and 63 are provided with cleaning bristles 56.

The brush body segments 62, 63 are rotationally fixedly connected to each other, more specifically, by way of a torque transmitter member of the brush body 60, which, as in the present case, is preferably configured as shaft 64. The shaft 64 engages the end sections 65, 66 of the brush body segments 62 and 63, respectively, which face the respective other brush segment 62, 63, and is rotationally fixedly held on these. The rotationally fixed connection is made by, for example, positive locking or fixing by means of an additional connecting element.

The brush unit 52 comprises for mounting and fixing on the floor cleaner 10 a bearing device 68 which is arranged axially between the bush body segments 62 and 63 and, therefore, between the ends 58 and 59 of the brush body 60. In particular, the distance of the bearing device 68 from the first end 58 is approximately 60% of the length of the brush body 60.

The shaft 64 extends axially through the bearing device 68 which is thereby positioned radially on the outside of the shaft. The bearing device 68 comprises a radial bearing which surrounds the shaft 64 and, in the present case, is configured as ball bearing 69, and a bearing body 70 which is mounted by way of the ball bearing 69 about the brush axis 36 on the shaft 64 and, therefore, on the brush body 60.

The bearing body 70 comprises a bearing section 71 between the brush body segments 62, 63, which surrounds the ball bearing 69 and, in the present case, is of ring-shaped construction. The bearing body 70 further comprises a fixing section 72 which surrounds the bearing section 71 radially and is arranged radially on the outside in relation to the brush body 60. The fixing section 72 and the bearing section 71 are connected to each other by way of axially effective spring members which, in the present case, are configured as spring webs 73. In total, three elastically resilient spring webs 73 are provided. These can act upon the brush body 60 with a spring force in the direction of the drive device 38 in order to avoid play with the drive element 51 and to ensure a reliable rotationally fixed connection.

The fixing section 72 is of substantially plate-shaped configuration and has at an upper edge, in relation to specified use of the cleaning brush 24 with the floor cleaner 10, a fixing member 74 for fixing the brush unit 52 to the floor cleaner 10. The fixing member 74 is, in the present case, a locking element and, in particular, forms a hook-shaped locking projection 75 facing in the direction of the front side 14.

Figure 5:
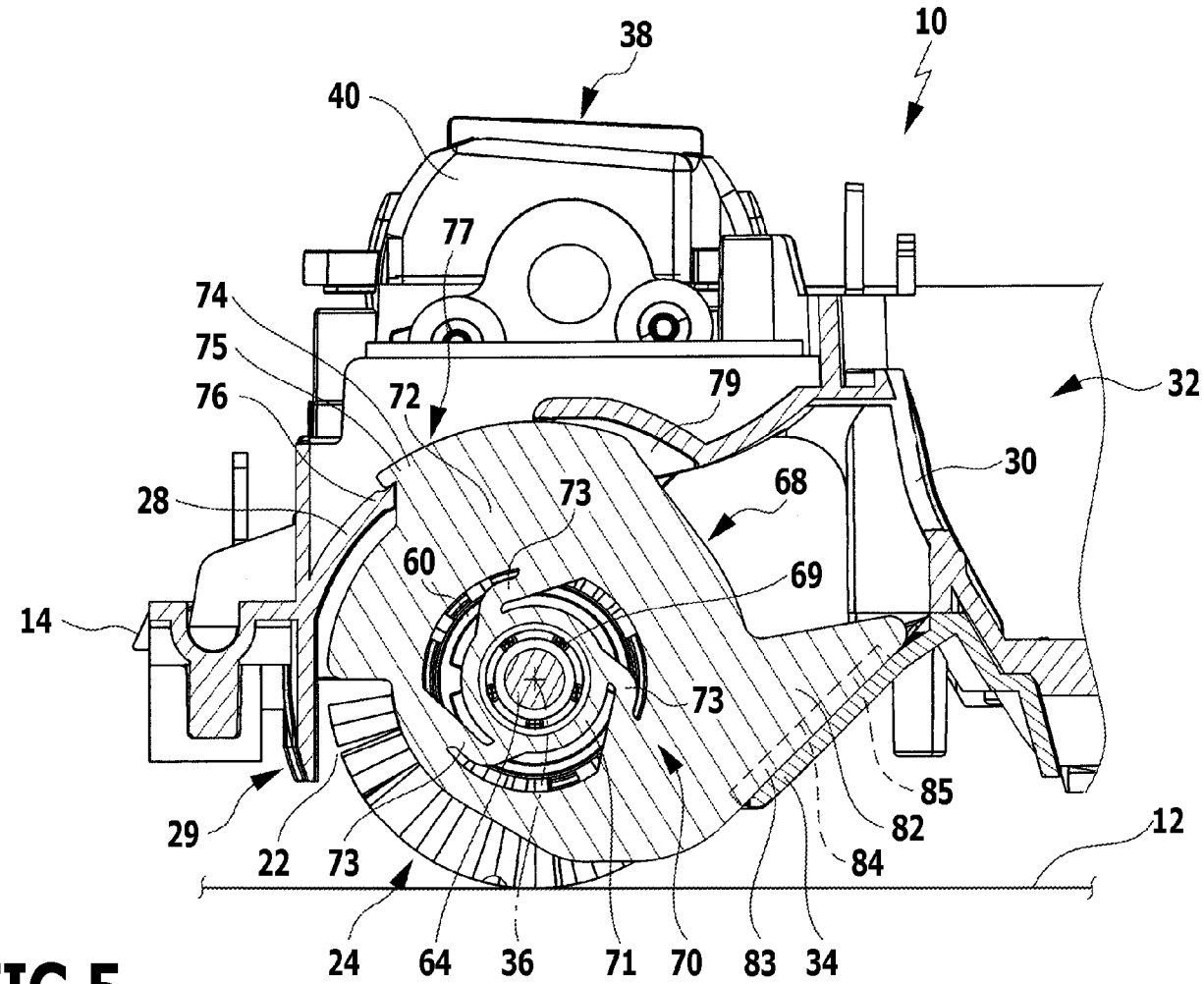
FIG. 5 shows a sectional view along line 5-5 in FIG. 2, with some components of the floor cleaner faded out.

Associated with the fixing member 74 is a corresponding fixing member 76 of the floor cleaner 10, which is arranged on the wall 28 of the brush accommodating compartment 22. The fixing member 76 comprises a locking receptacle 77 which the locking projection 75 can engage in a locking manner. As can be seen, in particular, from FIG. 7, the locking receptacle 77 has a slit-shaped through-opening 78 formed in the wall 28. To fix the bearing body 70 to the wall 28, the locking projection 75 can be inserted into the through-opening 78 and locked at its front edge by a rotational movement (FIG. 5). In this way, the interacting fixing members 74 and 76 allow the bearing body 70 and, therefore, the brush unit 52 to be fixed by way of a kind of bayonet lock in a horizontally aligned manner to the floor cleaner 10. In particular, manual fixing without any tools is possible. Moreover, the fixing can also be manually released again without any tools by disengaging the locking of the fixing members 74 and 76, and the bearing bodies 70 thereby separated from the floor cleaner 10.

Arranged axially beside the through-opening 78 are projections 79 and 80, which project from the wall 28 into the brush accommodating compartment 22. The projections 79 and 80 receive the bearing body 70 at its upper edge substantially without play between them when it is locked to the wall 28. The projections 79 and 80 thereby allow an axial alignment of the bearing body 70 and, therefore, an axial fixing of the brush unit 52.

In the direction of the guide element 34, the fixing section 72 comprises a further fixing member 82 which is formed by a kind of wing-shaped projection. The fixing member 82 forms a strip-shaped locking projection 83 and can interact with fixing members 84 on the guide element 34. The fixing members 84 are strip-shaped locking projections 85 (FIGS. 2 and 5) which protrude into the brush accommodating compartment 22. The locking projections 85 receive the locking projection 83 substantially without play between them and thereby also allow an axial fixing of the bearing body 70 in addition to a mounting and rotational securing about the brush axis 36. The fixing members 82 and 84 can also be connected to one another and separated from one another manually without any tools.

At the first end 58, the brush unit 52 comprises a torque receiver device 86 which has a recess 87 (FIG. 6) formed in the brush body 60. The recess 87 is formed in such a way the drive element 51 can engage it with positive locking in order to transmit a torque onto the brush unit 52 and drive it rotationally about the brush axis 36. In particular, the drive element 51 only engages the brush body 60 at the end section forming the first end 58 and so the brush unit 52 can be positioned in a simple way substantially axially on the drive device 38.

Figure 2:
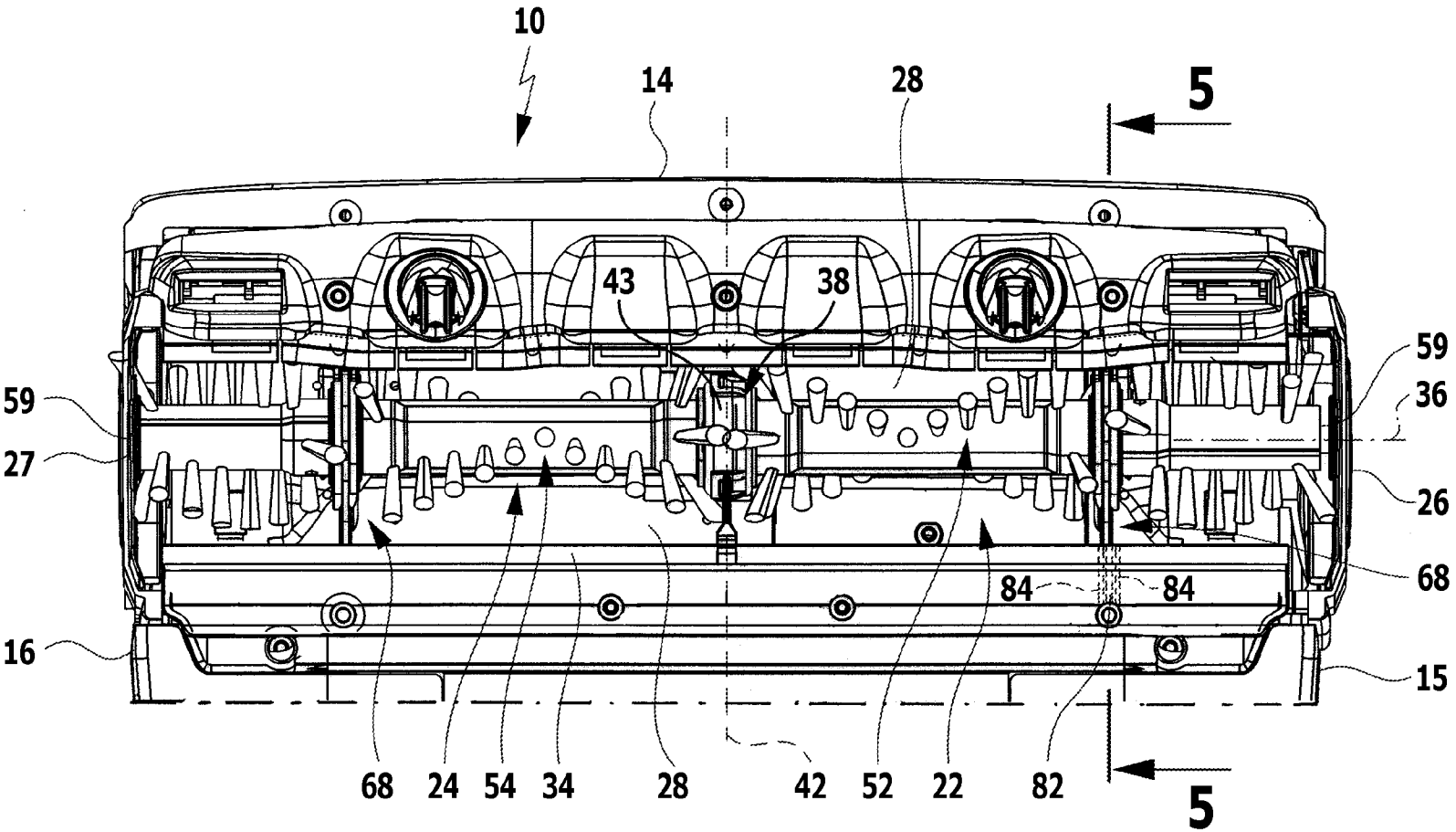
FIG. 2 shows a partial representation of a front region of the floor cleaner from FIG. 1 from below.

Also arranged at the first end 58 are cleaning bristles 56 which are positioned at an axial inclination in the direction of the other brush unit 54. The inclined position of the cleaning bristles 56 is such that they project over the first end 58 and thereby engage under the drive device 38 on the gear housing 43. The cleaning bristles 56 of both brush units 52, 54 are of such length that the sweeping patterns on the floor surface 12 overlap one another (FIGS. 2 and 3). In other words, the cleaning bristles 56 of the brush units 52, 54 intersect one another underneath the gear housing 43 in relation to the same angle of rotation with respect to the brush axis 36. This allows the floor surface 12 underneath the gear housing 43 to also be covered with cleaning bristles 56 and cleaned without streaks.

The sweeping patterns of cleaning bristles 56 arranged at the end sections 65 and 66 of the brush body segments 62 and 63, respectively, overlap in a corresponding manner. The cleaning bristles 56 adjacent to the bearing device 68 are each positioned at an inclination in the direction of the other brush body segment 62, 63 and thereby project to beneath the bearing device 68 (FIG. 3). The floor surface 12 in the region of the bearing device 68 can thereby also be cleaned without streaks because the inclined cleaning bristles 56 contact it.

Also at the second end 59 cleaning bristles 56 are arranged, which are positioned at an inclination in relation to the brush axis 36, more specifically, such that the cleaning bristles 56 project at the side over the second end 59. A region of the floor surface 12 which lies axially outside of the brush body 60 can thereby be contacted and cleaned by the brush unit 52. The total area of the floor surface 12 covered by the cleaning brush 24, therefore, extends substantially over the entire width of the brush accommodating compartment 22 (FIG. 2).

As is also clear from FIG. 2, the cleaning bristles 56 projecting over the second end 59 also allow particularly good cleaning of floor surfaces close to the edge using the floor cleaner 10. For this purpose, the brush covers 26 and 27 are constructed so as to be axially displaceable relative to the remaining housing 20. The brush covers 26 and 27 can each be transferred from a bristle covering position in which they project laterally over the cleaning bristles 56 at the second end 59 along the brush axis 36 to a bristle releasing position in which the cleaning bristles 56 project laterally over the brush covers 26, 27 along the brush axis 36, and vice versa. FIG. 2 shows the brush cover 26 in the bristle covering position in which it is arranged in the transverse direction laterally outside of the cleaning bristles 56 at the second end 59 of the brush unit 52. Obstacles such as, for example, drapes or curtains can thereby be protected against contact with the rotating cleaning brush 24.

In contrast, the brush cover 27 assumes a bristle releasing position owing to it having been displaced in the direction of the brush unit 54 on the housing 20. The displacement path of the brush cover 27 is a few millimeters, for example, approximately 3 mm to 5 mm. The cleaning bristles 56 at the second end of the brush unit 54 project laterally over the brush cover 27 along the brush axis 36, and, in particular, sections thereof project under this brush cover. Particularly good cleaning close to the edge can thereby be achieved, as is described in the patent application DE 10 2012 104 326.4 of the same applicant. The disclosure of this application is incorporated in its entirety in the present application.

The displaceable brush covers 26, 27 allow, in particular, a so-called "wall following trip" to be taken, with simultaneous cleaning of the floor surface 12 close to the wall, as is also described in the patent application DE 10 2012 104 326.4.

With the displaceable brush covers 26 and 27, it proves advantageous, in particular, that the cleaning brush 24 at the second ends 59 is free of a bearing device for mounting and holding on the floor cleaner 10. This allows the cleaning bristles 56 at the second end 59 not to be excessively long in order to still project under the brush covers 26, 27.

Use of the bearing device 68 arranged at a distance from the second ends 59 allows reliable mounting and supporting on the floor cleaner 10. Unlike in the publication DE 10 2007 006 654 A1 mentioned at the outset, it is, in particular, not necessary to provide a shaft of the drive device 38 extending close to the second end 59, which is inserted into almost the entire brush body 60. As a result, the drive device and, in particular, its drive element 51, as mentioned above, can be of such small configuration that a support of relatively small spatial extent occurs at the drive device 38 and nevertheless a reliable transmission of the torque to the brush units 52 and 54 is possible. The arrangement of the bearing device 68 at a distance from the second end 59 also allows radial forces to be conducted away better to the floor cleaner 10 and, in particular, a bending of the brush body 60 to be avoided, as may occur in an undesired manner, for example, with bearings located only on the outside at the first and second ends 58, 59.

The brush units 52 and 54 can be connected to and released from the floor cleaner 10 separately from each other, as described hereinabove. If required, it is, therefore, possible to also exchange only one of the brush units 52, 54.

The invention claimed is:

1. A floor cleaner, comprising a housing which forms a brush accommodating compartment, a cleaning brush arranged in the brush accommodating compartment with two separate brush units, and a drive device for the cleaning brush, the respective brush unit having a brush body defining a brush axis and being provided with cleaning bristles and having a first end and a second end, and the respective brush unit comprising at the first end or in the region of the first end a torque receiver device, the drive device coupling to the torque receiver device at the first end of the brush body of the respective brush unit and rotationally driving the respective brush unit, wherein the respective brush unit comprises a bearing device for mounting on the floor cleaner, which is arranged between the first end and the second end, the brush units being adapted to be connected to and released from the floor cleaner separately from each other.

2. The floor cleaner in accordance with claim 1, wherein the respective brush unit is free of a bearing device for mounting on the floor cleaner at the second end.

3. The floor cleaner in accordance with claim 1, wherein the bearing device is at a distance from the first end, which corresponds to approximately 50% to approximately 70% of the length of the brush body.

4. The floor cleaner in accordance with claim 1, wherein the brush body is provided with cleaning bristles on both sides of the bearing device, and wherein cleaning bristles arranged on opposite sides of the bearing device and adjacent thereto are positioned at an axial inclination in relation to the brush axis in the direction of the respective other side of the bearing device.

5. The floor cleaner in accordance with claim 4, wherein on a floor surface to be cleaned, sweeping patterns of cleaning bristles of the brush unit positioned at an inclination on opposite sides of the bearing device border on one another or overlap one another.

6. The floor cleaner in accordance with claim 1, wherein cleaning bristles of the brush unit at or near the first end and/or the second end are positioned at an axial inclination in relation to the brush axis and project beyond the first end and beyond the second end, respectively, of the brush body.

7. The floor cleaner in accordance with claim 1, wherein the torque receiver device has a recess arranged at the first end in the brush body for a corresponding drive element of the drive device.

8. The floor cleaner in accordance with claim 1, wherein the brush body is axially divided into a first brush body segment forming the first end and a second brush body segment forming the second end, the second brush body segment being connected to the first brush body segment.

9. The floor cleaner in accordance with claim 8, wherein the brush body segments are connected to each other at the bearing device, and wherein the bearing device is arranged axially between the brush body segments.

10. The floor cleaner in accordance with claim 8, wherein for connecting the brush body segments, the brush body comprises a torque transmitter member engaging these, in each case, in a rotationally fixed manner, and extending through the bearing device.

11. The floor cleaner in accordance with claim 1, wherein the bearing device comprises a bearing body and, in relation to the brush axis, comprises or forms a radial bearing, and wherein the bearing body has a bearing section which is mounted by way of the radial bearing on the brush body, and a fixing section which is connected to the bearing section and on which at least one fixing member is arranged for fixing to the floor cleaner.

12. The floor cleaner in accordance with claim 11, wherein the radial bearing is configured as ball bearing.

13. The floor cleaner in accordance with claim 11, wherein the bearing body comprises at least one spring member by way of which the bearing section is supported in an axially and/or radially sprung manner on the fixing section.

14. The floor cleaner in accordance with claim 13, wherein spring webs connecting the bearing section and the fixing section to each other are provided as spring members.

15. The floor cleaner in accordance with claim 11, wherein the at least one fixing member comprises or forms a locking element for locking to a corresponding locking element of the floor cleaner.

16. The floor cleaner in accordance with claim 11, wherein the at least one fixing member is configured to form a rotational lock with the floor cleaner.

17. The floor cleaner in accordance with claim 11, wherein the bearing body is in one piece.

18. The floor cleaner in accordance with claim 1, wherein at least a section of the bearing body is of plate-shaped configuration.

19. The floor cleaner in accordance with claim 1, wherein the two brush units, in relation to coinciding brush axes thereof, are configured symmetrically or substantially symmetrically relative to each other with respect to a plane of symmetry which is aligned perpendicularly to the brush axes of the brush units.

20. The floor cleaner in accordance with claim 1, wherein the brush axis is a transverse axis aligned transversely to a main direction of movement of the floor cleaner.

21. The floor cleaner in accordance with claim 1, wherein the drive device comprises a drive element which is rotationally drivable about the brush axis and engages a corresponding recess of the brush body.

22. The floor cleaner in accordance with claim 1, wherein the drive device comprises a drive motor outside of the brush accommodating compartment and a torque transmitter device interacting with the drive motor, the torque transmitter device being arranged in the brush accommodating compartment and being coupled to the torque receiver device of the respective brush unit.

23. The floor cleaner in accordance with claim 1, wherein the floor cleaner comprises or forms at or in the brush accommodating compartment at least one fixing member which interacts with a fixing member of the bearing device of the respective brush unit to fix the cleaning brush on the floor cleaner.

24. The floor cleaner in accordance with claim 23, wherein the at least one fixing member of the floor cleaner is included in or formed by a wall of the brush accommodating compartment.

25. The floor cleaner in accordance with claim 23, wherein the at least one fixing member of the floor cleaner comprises or forms a locking element for locking to a corresponding locking element of the cleaning brush.

26. The floor cleaner in accordance with claim 23, wherein the at least one fixing member of the floor cleaner is configured to form a rotational lock with the bearing device of the respective brush unit.

27. The floor cleaner in accordance with claim 1, wherein the brush axes of the brush units coincide, and wherein at least a section of the drive device is axially arranged between the brush units.

28. The floor cleaner in accordance with claim 27, wherein cleaning bristles of the brush units arranged at or near the respective first ends are positioned at an axial inclination and project beyond the respective first ends in the direction of the respective other brush unit, and wherein on a floor surface to be cleaned, sweeping patterns of the cleaning bristles of both brush units border on one another or overlap one another.

29. The floor cleaner in accordance with claim 27, wherein the housing comprises or forms brush covers which cover at least sections of the respective second ends of the brush bodies at the end face.

30. The floor cleaner in accordance with claim 29, wherein at least one brush cover is constructed so as to be movable relative to the remaining housing and is transferable from a bristle covering position in which the brush cover projects along the brush axis laterally over cleaning bristles arranged at or near the second end of the brush unit facing it, to a bristle releasing position in which the cleaning bristles project along the brush axis laterally over the brush cover, and vice versa.

31. The floor cleaner in accordance with claim 30, wherein the at least one movable brush cover is displaceable on the housing relative to the cleaning brush for transfer from the bristle covering position to the bristle releasing position and vice versa.

32. The floor cleaner in accordance with claim 30, wherein the at least one movable brush cover is arranged on the outside of the housing and, in the bristle covering position, preferably also in the bristle releasing position, forms a section of the outer contour of the housing.

33. The floor cleaner in accordance with claim 1, wherein the floor cleaner is of self-propelled and self-steering configuration.

* * * * *